United States Patent [19]

Lack

[11] Patent Number: 4,671,014

[45] Date of Patent: Jun. 9, 1987

[54] DOOR BARRICADE SYSTEM

[75] Inventor: Larry H. Lack, Phoenix, Ariz.

[73] Assignees: Dawn J. Underwood, Chandler; James H. Phillips, Phoenix, both of Ariz.

[21] Appl. No.: 923,049

[22] Filed: Oct. 24, 1986

[51] Int. Cl.[4] ..... E05B 65/06

[52] U.S. Cl. ..... 49/394; 292/263; 292/238; 292/288

[58] Field of Search ..... 49/394; 292/289, 297, 292/298, 263, 288, 238

[56] References Cited

U.S. PATENT DOCUMENTS

| | | | |
|---|---|---|---|
| 3,059,952 | 10/1962 | Wittman et al. | 292/288 |
| 3,206,793 | 9/1965 | Silverberg | 292/288 X |
| 3,248,142 | 4/1966 | Schackerman | 292/238 |
| 4,391,463 | 7/1983 | Costa Bastart | 292/263 |

*Primary Examiner*—Kenneth Downey
*Attorney, Agent, or Firm*—James H. Phillips

[57] ABSTRACT

A very secure entry door barricade system is obtained with a specially configured elongated bar which extends generally horizontally across the width of a door. A hasp assembly, which is very firmly anchored to the building structure, includes a pivotally movable hasp adapted to selectively engage a hook portion of the bar. At the hinge edge, the elongated bar is very securely anchored by a conventional hinge pin which passes through a vertical aperture in the bar and back into its hinge assembly. An alternative configuration for double doors employs an elongated bar on each door, the bar pair being generally in horizontal alignment with respective hook portions situated in close proximity to receive a ring over both hook portions. The ring, when in place, thereby serves to closely limit the extent to which either or both doors can be opened.

7 Claims, 6 Drawing Figures

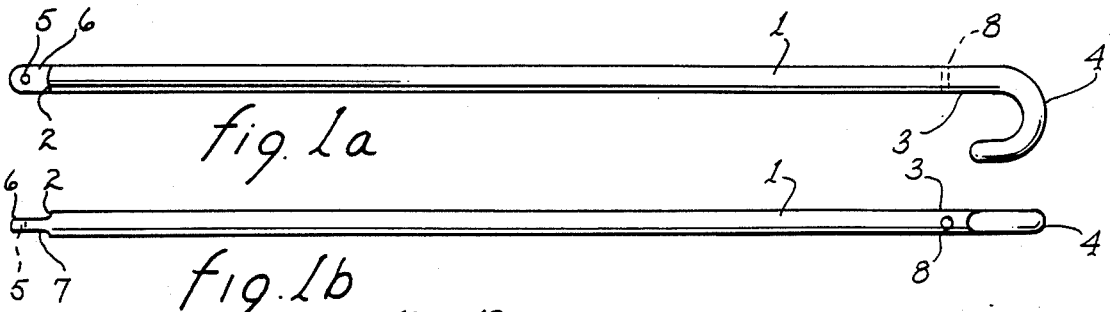
fig. 1a
fig. 1b
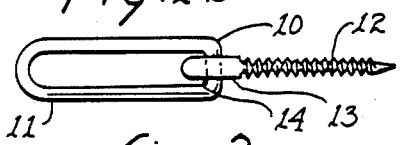
fig. 2
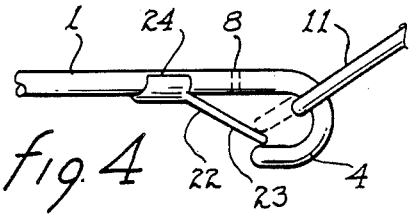
fig. 4
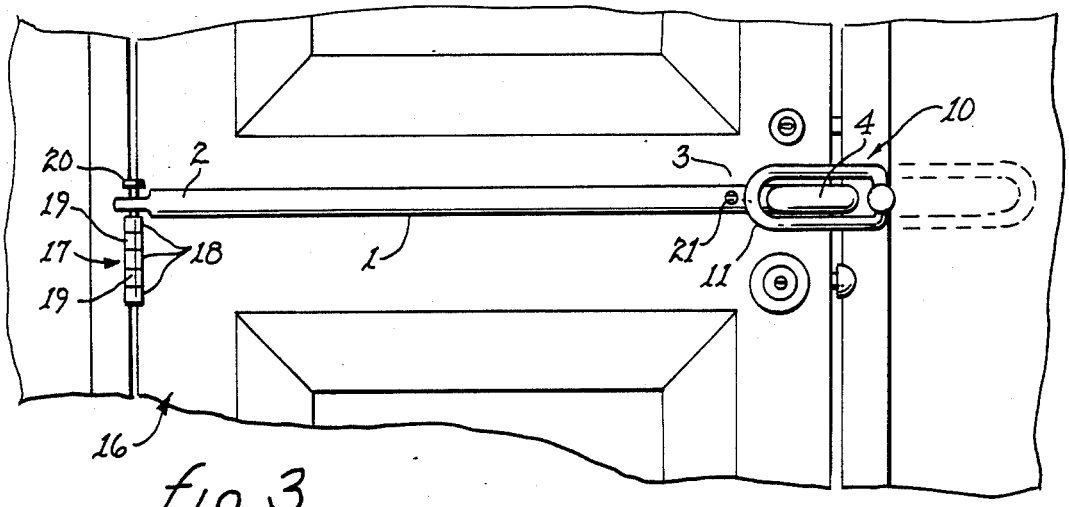
fig. 3
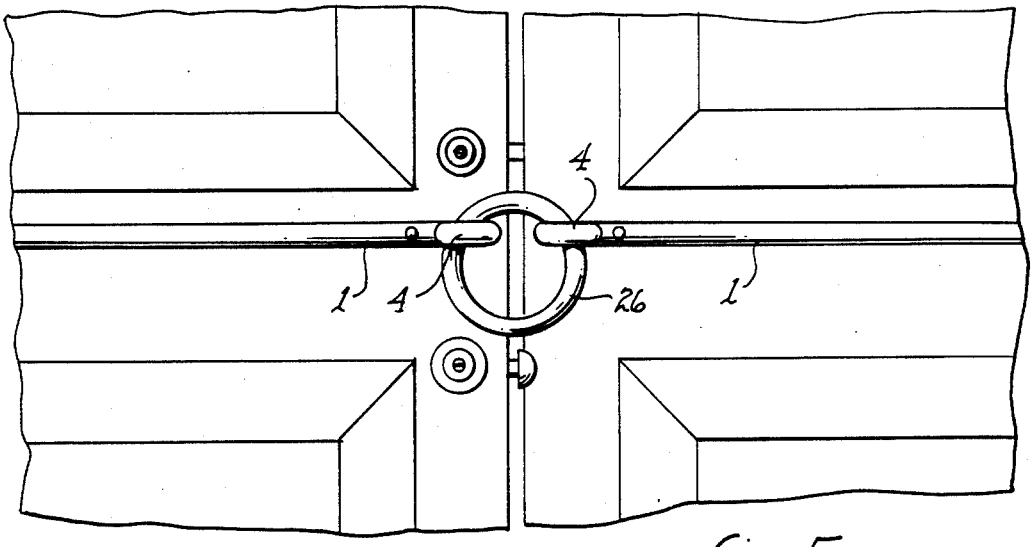
fig. 5

DOOR BARRICADE SYSTEM

FIELD OF THE INVENTION

This invention relates to the personal safety arts and, more particularly, to a system for effectively barricading an entry door from within.

BACKGROUND OF THE INVENTION

The need for effectively barricading an entry door from within is notoriously well known as is the relative ineffectiveness of known systems and devices for achieving this end. For example, in regions (such as some urban areas) in which the crime rate is sufficiently high, virtually every household is provided with a plurality of locks and related devices operated simultaneously on each entrance door to undertake to establish a barricade which will prevent all but the most determined attempts at unauthorized entry. Typically, one or more dead bolt or other key/latch-operated locks are positioned on a door for parallel operation, often in conjunction with bolt operated supplementary devices and/or devices (such as the well-known "chain lock") which permit limited opening of a door before becoming effective.

Those skilled in the security arts are well aware of the draw backs of all these devices, most particularly, their vulnerability to simple brute force unauthorized entry attempts. That is, a sufficiently heavy inwardly directed blow to an entry door will result in ripping the locks and related devices from the door and/or the door frame because the barricade system is only as strong as the cumulative effect of the fastening devices, typically wood screws, in the door and door frame.

It will therefore be appreciated that it would be highly desirable to provide an entry door barricade system that does not suffer from this basic vulnerability to brute force unauthorized entry, and it is to this end that the present invention is directed.

OBJECTS OF THE INVENTION

It is therefore a broad object of my invention to provide an improved barricade system for an entry door.

It is another object of my invention to provide such a barricade system that permits very safe limited opening of an entry door with which it is used.

In another aspect, it is an object of my invention to provide such a barricade system which is relatively simple to install and which therefore admits for installation alike by a professional locksmith and an unskilled occupant.

It is a still further object of my invention to provide such a barricade system which is integrated with a door and a building structure in such a manner that it cannot be easily defeated by a brute force attempt at unauthorized entry.

SUMMARY OF THE INVENTION

These and other objects of my invention are achieved with a specially configured elongated bar, which extends generally horizontally across the width of a door, and a hasp assembly which is very firmly anchored to the building structure and which includes a pivotally movable hasp adapted to selectively engage a hook portion of the bar situated at the door edge opposite the hinge. At the hinge edge, the elongated bar is very securely anchored by a conventional hinge pin which passes through a vertical aperture in the bar and back into its hinge assembly. An alternative configuration for double doors employs an elongated bar on each door, the bar pair being generally in horizontal alignment with their respective hook portions situated in close proximity to receive a ring over both hook portions. The ring, when in place, thereby serves to closely limit the extent to which either or both doors can be opened.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

FIGS. 1*a* and 1*b* are, respectively, top and side views of an elongated bar principal component of the system;

FIG. 2 is a pictorial view, illustrated uninstalled, of a hasp assembly component of a single door embodiment of the invention;

FIG. 3 is a partially cutaway view of a single door embodiment of the invention illustrating the installed and operative relationship between the system components;

FIG. 4 is a partially cutaway illustration showing a variant configuration for a hook portion of the elongated bar of FIG. 1; and FIG. 5 illustrates the system as adapted to a side-by-side double door entry way.

DETAILED DESCRIPTION OF THE INVENTION

Referring now to FIGS. 1*a* and 1*b*, there are shown two views of an elongated bar 1 which is a principal component of the invention. The elongated bar has first and second ends, generally indicated at 2, 3, and the second end 3 includes a hook portion 4 which folds back toward the main portion of the elongated bar through a curve in excess of ninety degrees and preferably on the order of approximately one hundred eighty degrees as illustrated. The elongated bar 1 may have a round, square of other cross section and is preferably fabricated from a tough metal such as mild steel. Typically, the bar may be about ½ inch thick across its diameter or smallest cross sectional dimension or, in any event, of sufficient thickness to afford essentially impossible distortion by manual force.

Situated near the first end 2 of the elongated bar 1 is an aperture 5 which is directed perpendicular to the length of the bar and is dimensioned and configured to receive a hinge pin as will be more completely discussed below. Preferably, the regions 6, 7 immediately above and below the aperture 5 are relieved to provide flat surfaces if the bar 1 is generally circular in cross section. The reason for providing the flat regions 6, 7 will become more apparent below. A second aperture 8 is situated intermediate along the length of the elongated bar and preferably near the region at which the hook portion 4 commences. The aperture 8 also directed perpendicular to the length of the bar 1, but is also disposed perpendicular to the aperture 5.

FIG. 2 illustrates a second, hasp assembly 10, principal component of the invention. The hasp assembly 10 includes a pivotally movable hasp 11 in the form of a continuous loop structure of sufficient length to pivot over the hook portion 4 of the bar 1 as will be described more fully below. The hasp assembly 10 also has an integral securement piece which includes an elongated threaded portion 12 and an eye portion 13. The eye portion 13 is provided with an aperture 14 through which a short section of the hasp 11 passes such that the hasp 11 and the eye portion 13 of the securement piece are pivotally coupled. All components of the hasp assembly, like the elongated barl, are fabricated from a tough metal such as mild steel, and the hasp 11 may usefully be hardened.

The manner in which the barricade system is easily installed in a single door configuration may best be appreciated by reference to FIG. 3 which shows a door 16 suspended on a hinge system which includes at least one hinge assembly 17 having first and second sections 18, 19 which are secured together in the conventional fashion by a hinge pin 20. In order to install the bar component of the system, the hinge pin 20 is removed to decouple the hinge sections 18, 19, and the first end 2 of the bar 1 is positioned above the hinge assembly 17. Then, the hinge pin may be reinserted by first passing it through the aperture 5 (FIG. 1*a*) and back into the hinge assembly 17 to recouple the hinge sections 18, 19. For a circular cross section bar 1, the flats6. 7 decrease the upward displacement of the hinge pin 20 and also provide a flat seating area for the top of the hinge assembly 17 and the bottom of the head of hinge pin 20.

The bar 1 is held horizontally while support for the bar is established to prevent it from pivoting downwardly under its own weight. A convenient bar support method is to run a screw 21 (having threads appropriate to the material from which the door 16 is fabricated and into a previously drilled pilot hole if appropriate) through the aperture 8 (FIG. 1*b*). It will be appreciated that the provision for horizontal support of the bar 1 bears only the partial weight of the bar and does not otherwise contribute to the integrity of the barricade system. Therefore, any convenient alternative method for supporting the bar horizontally toward its second end 3 may be employed.

Next, an appropriately sized pilot hole (according to the dimensions of the threaded portion 12 of the securement piece 10—FIG. 2) is drilled through the door frame and deeply into an upright in the framework of the building in the wall interior. Ideally, this depth will extend very nearly through the larger cross sectional dimension of a two-by-four or like component on the building frame itself to obtain the sought after strength of the barricade system. The hasp assembly my now be affixed to the building frame by threading the securement piece into the pilot hole using the hasp 11 as a wrench or directly employing an appropriate wrench. When the hasp assembly 10 has veen correctly installed, it is oriented for horizontal pivotal movement of the hasp 11 from the engaged position illustrated in FIG. 3 and a disengaged position indicated by dashed lines.

Those skilled in the safety arts will now understand the extraordinary strength of the subject system. The hasp and bar assembly simply cannot be separated manually from the outside if the door is opened slightly as the hasp 11 will immediately engage the hook portion 4 of the bar 1. The inherent strength of these components (which, as previously noted, are ideally made from steel or other very strong metal) prevents their being manually distorted by any manual force from outside the door. The hasp 11 is preferably sufficiently hard so as to prevent easy cutting, even by powerful cutters which make short work of a chain lock. The hasp assembly 10 is, if installed correctly, very deeply embedded in the structure of the building itself. The first end 2 of the bar 1 is securely affixed to the (typically hardened) hinge pin 20 in such a manner that the hinge screws would have to be ripped laterally from either or both the door and door frame, a virtual impossibility with any force short of that which will fracture the door panels themselves. With regard to that point, the strength of the door itself may be supplemented by employing a barricade system according to the present invention at each hinge position on the door.

In order to guard against the possibility that the hasp 11 might be swung out of engagement by some sort of tool inserted from the outside and working through the crack between the door and the door frame, a hasp retainer 22 may be employed as best shown in FIG. 4. Hasp retainer 22 includes an angularly situated flexible arm 23 having a first end which is fixed to the bar 1 (by any convenient means such as spot welding) at a region 24 which is skewed toward the other end of the bar 1 and a second end which extends to a position within and near a tip end of the hook portion 4. The operation of a hasp retainer 22 will be readily understood from FIG. 4. When the hasp 11 is to be engaged with the hook portion 4, the flexible arm 23 is pushed inwardly to permit passage of the hasp 11 past the near juncture of the flexible arm 23 and the hook portion 4. When the flexible arm 23 is released it springs to the position illustrated in FIG. 4, and the hasp 11 cannot thereafter be disengaged from the hook portion 4 without manually depressing the flexible arm 23, an operation which can only be performed from inside the door.

The subject barricade system also finds ready application in a double entry door installation. Thus, referring now to FIG. 5, it will be seen that a pair of oppositely disposed bars 1 are aligned and horizontally positioned such that their respective hook portions are proximately situated when the doors are closed. Installation of the bars 1 will have previously been carried out in exactly the same manner as discussed above for the single door configuration. However, in the double door configuration illustrated in FIG. 5, no hasp assembly is used. In its place, a loop structure 26 may simply be draped over the respective hook portions 4 of the two bars 1 as illustrated. The loop structure 26 is dimensioned and configured to just be engageable simultaneously with both the hook portions 4 when both doors are closed. Thereafter, any attempt to open either or both doors will simply result in respective hook portions 4 being constrained by the loop structure 26. The loop structure 26, of course, must also be made of a very strong and, preferably, hard material to prevent the system from being readily defeated by ordinary cutting instruments inserted through the crack between the doors.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing-from those principles.

I claim:

1. A barricade system for preventing unauthorized entry through a doorway comprising:

(A) a door hung in the doorway on a plurality of hinges including at least one hinge assembly empolying first and second hinge sections and a removable vertical hinge pin to detachably couple said first and second sections of said hinge assembly;

(B) an elongated bar assembly including an elongated bar having first and second ends, said elongated bar assembly further including:

(1) a first aperture extending through said bar proximate said first end, said first aperture being directed perpendicular to the length of said bar and dimensioned and configured to receive said hinge pin such that said first end of said bar may be fixed in place by:

i. temporarily removing said hinge pin from said hinge assembly to decouple said first and second hinge sections;

ii. passing said hinge pin through said first aperture; and iii. replacing said hinge pin in said hinge assembly to recouple said first and second hinge sections;

(2) bar support means situated intermediate the length of said bar and adapted to affix said bar to said door such that said bar is supported by said hinge assembly and said support means to extend generally horizontally across substantially the width of said door; and (3) a hook portion at said second end, said hook portion extending through a curve of more than ninety degrees; and C. a hasp assembly adapted for selective engagement with said elongated bar, said hasp assembly including:

(1) securement means for securely affixing said hasp assembly proximate the doorway independently of said door and in alignment with said elongated bar;

(2) a movable hasp comprising a loop structure adapted to selectively pass over said hook portion and encompass said bar proximate said second end thereof; and (3) swing means pivotally coupling said securement means and said hasp;

whereby, when said door is closed, said hasp may be pivoted over said hook portion of said bar to prevent said door from being opened in excess of an amount at which said hook portion is constrained by said hasp.

2. The barricade system of claim 1 in which said bar support means comprises a second aperture extending through said bar, said second aperture being directed perpendicular to the length of said bar and perpendicular to said first aperture, said second aperture being dimensioned and configured to receive a fastening device for fixing said bar to said door.

3. The barricade system of claim 2 in which said fastening device is a screw passing through said second aperture and screwed into said door.

4. The barricade system of claim 1 which further includes:

(A) a hasp retainer, said hasp retainer comprising:

(1) a flexible arm having first and second ends; and (2) means fixing said first end of said flexible arm to said elongated bar at a position intermediate said hook portion and said first aperture in such an orientation that said second end of said flexible arm extends within said hook portion and proximate a tip end there;

whereby, when said hasp is pivoted over said hook portion, it depresses and springs by said flexible arm, said flexible arm thereafter retaining said hasp in said hook portion until said flexible arm is manually depressed to provide passage for said hasp past said second end of said flexible arm.

5. A barricade system for preventing unauthorized entry through a doorway comprising:

(A) left and right doors hung in the doorway, each said door being hung on a plurality of hinges including:

(1) at least one hinge assembly employing first and second hinge sections; and (2) a removable vertical hinge pin to detachably couple said first and second sections of said hinge assembly;

(B) left and right elongated bar assemblies including first and second elongated bars disposed, respectively, on said left and right doors, each said elongated bar having first and second ends, each said left and right elongated bar assemblies further including:

(1) a first aperture extending through said bar proximate said first end, said first aperture being directed perpendicular to the length of said bar and dimensioned and configured to receive said hinge pin of said hinge assembly associated with said respective door such that said first end of said bar may be fixed in place by:

i. temporarily removing said hinge pin from said hinge assembly associated with said respective door to decouple said first and second hinge sections thereof;

ii. passing said hinge pin through said first aperture; and iii. replacing said hinge pin in said hinge assembly associated with said respective door to recouple said first and second hinge sections thereof;

(2) bar support means situated intermediate the length of said bar and adapted to affix said bar to said respective door such that said bar is supported by said respective hinge assembly and said support means to extend generally horizontally across substantially the width of said respective door; and (3) a hook portion at said second end, said hook portion extending through a curve of more than ninety degrees; and (C) a loop structure adapted to selectively pass over said hook portions of both said first and second bars and encompass said first and second bars bar proximate their respective said second ends;

whereby, when said doors are both closed, said loop structure may be introduced over both said hook portions of said first and second bars to prevent said doors from being opened in excess of an amount at which said hook portions are constrained by said loop structure.

6. The barricade system of claim 5 in which each said bar support means comprises a second aperture extending through said respective bar, said second aperture being directed perpendicular to the length of said respective bar and perpendicular to said first aperture through said respective bar, said second aperture being dimensioned and configured to receive a fastening device for fixing said bar to said respective door.

7. The barricade system of claim 6 in which each said fastening device is a screw passing through said respective second aperture and screwed into said respective door.

* * * * *